US007651065B2

(12) United States Patent
Sloan

(10) Patent No.: US 7,651,065 B2
(45) Date of Patent: Jan. 26, 2010

(54) STORAGE SYSTEM FOR SEA-LAND SHIPPING CONTAINER

(76) Inventor: Michael Jeffrey Sloan, 1108 Highwood La., Coeur d'Alene, ID (US) 83815

( * ) Notice: Subject to any disclaimer, the term of this patent is extended or adjusted under 35 U.S.C. 154(b) by 63 days.

(21) Appl. No.: 11/901,976

(22) Filed: Sep. 21, 2007

(65) Prior Publication Data

US 2008/0011920 A1 Jan. 17, 2008

Related U.S. Application Data

(63) Continuation-in-part of application No. 11/026,001, filed on Dec. 31, 2004, now abandoned.

(51) Int. Cl.
*B42F 13/00* (2006.01)

(52) U.S. Cl. ..... 248/339; 235/250; 211/90.01; 211/90.02; 211/90.04

(58) Field of Classification Search ..... 248/339, 248/235, 250; 211/90.01, 90.02, 90.04, 87.01, 211/118, 117

See application file for complete search history.

(56) References Cited

U.S. PATENT DOCUMENTS

| | | | | |
|---|---|---|---|---|
| 4,188,890 | A * | 2/1980 | de Villers | 108/30 |
| 5,472,103 | A * | 12/1995 | Merl | 211/187 |
| 5,797,501 | A * | 8/1998 | Von Gunten | 211/90.01 |
| 6,138,841 | A * | 10/2000 | Klein et al. | 211/85.7 |
| 2003/0085188 | A1 * | 5/2003 | Klein et al. | 211/118 |

* cited by examiner

*Primary Examiner*—Amy J Sterling
(74) *Attorney, Agent, or Firm*—Bergman & Jeckle PLLC

(57) ABSTRACT

A storage system for inside a Sea-Land shipping container provides at least two hanging brackets, each bracket having a vertical beam with a hook at an upper end portion for releasable engagement with a lashing ring carried on a wall inside the Sea-Land shipping container to depend therefrom adjacent the wall. Supports extend forwardly outwardly from the hanging beams and are reinforced by braces communicating between the support and hanging beam. A squaring foot at a lower end portion of each hanging beam extends perpendicular thereto preventing axial rotation of the hanging beam. A vertical member at end portion of each support, opposite the hanging beam, prevents materials from falling off the support.

11 Claims, 4 Drawing Sheets

10
11
20
20a
20b
22
23
24
25
25a
29
30
31
31a
31b
31c
32
33
36
39
D

STORAGE SYSTEM FOR SEA-LAND SHIPPING CONTAINER

II. RELATED APPLICATIONS

This application is a Continuation in Part of application Ser. No. 11/026,001 filed on Dec. 31, 2004 now abandoned and titled Article of Manufacture Comprising a Support System for the Support of a Shelf or Shelves or Other Rigid or Non-Rigid Materials.

IIA. BACKGROUND OF INVENTION

IIB. Field of Invention

This invention relates to supports and racks, and more particularly to wall mounted shelf brackets.

IIC. Background and Description of Prior Art

Many individuals are employed in the construction field, such as electricians, plumbers, framers and the like. Frequently, these individuals require weatherproof and secure temporary on-site storage for their tools, equipment and supplies. One method of meeting the demand for such temporary on-site storage is through the use of Sea-Land shipping containers. Sea-Land shipping containers are ideal for providing weatherproof, secure temporary on-site storage because they are sturdy, they are weather resistant and they are portable. Unfortunately, Sea-Land shipping containers are typically void of any structure or method for organizing materials to be stored therein requiring that the user install some sort of shelving or storage system.

Various shelving and storage systems are known, but such systems are commonly permanently anchored to a vertical wall, or are anchored to the floor obstructing valuable floor space that is most conducive to storage of heavy items such as power tools.

Because most Sea-Land shipping containers that are used as temporary storage are rented, drilling holes in the container to anchor shelving and storage systems causes damage to the container for which the user may be charged and compromises the weatherproofness of the container. Further such permanently attached shelving and storage systems do not lend themselves to portability, may be costly in both materials and labor, and are often discarded at the close of construction when the need for the temporary on-site storage space no longer exists.

What is needed is a storage system for support of shelves and for support of rigid and non-rigid construction materials, supplies and equipment that does not interfere with the floor space therebelow, and does not require anchoring methods that damage or otherwise compromise the weatherproofness of the container.

The support system should be easy to install, portable and sufficiently durable to withstand the rigors of use in a construction site setting. Further, such support system must be easily storable when not in use and adaptable for uses other than supporting only shelves.

My storage system for Sea-Land shipping containers provides such a device and resolves various of the aforementioned drawbacks.

My storage system for Sea-Land shipping containers provides a user friendly, portable and durable storage system that depends from lashing rings structurally carried in spaced apart array inside the shipping container on the walls adjacent the ceiling. My storage system does not interfere with the floor space within the shipping container, does not require drilling holes in the shipping container, is easy to install and is adaptable for various uses including supporting shelving, supporting lengths of pipe stock, hanging coils of flexible pipe, rolls of wire and the like.

My invention does not reside in any one of the identified features individually but rather in the synergistic combination of all of its structures, which give rise to the functions necessarily flowing therefrom as hereinafter specified and claimed.

III. SUMMARY

A storage system for inside a Sea-Land shipping container provides at least two hanging brackets, each bracket having a vertical beam with a hook at an upper end portion for releasable engagement with a lashing ring carried on a wall inside the Sea-Land shipping container to depend therefrom adjacent the wall. Supports extend forwardly outwardly from the hanging beams and are reinforced by braces communicating between the support and hanging beam. A squaring foot at a lower end portion of each hanging beam extends perpendicular thereto preventing axial rotation of the hanging beam. A vertical member at end portion of each support opposite the hanging beam prevents materials from falling off the support.

In providing such an apparatus it is:

a principal object to provide a storage system for inside a Sea-Land shipping container.

a further object to provide such a storage system that does not require modification of the Sea-Land shipping container.

a further object to provide such a storage system that is wall supported.

a further object to provide such a storage system that does not occupy floor space inside a Sea-Land shipping container.

a further object to provide such a storage system that enhances accessibility to stored materials inside a Sea-Land shipping container.

a further object to provide such a storage system that is stable, user friendly and easy to install.

a further object to provide such a storage system that easy to disassemble and store when not in use.

a still further object to provide such a storage system that is of new and novel design, of rugged and durable nature, of simple and economic manufacture and one that is otherwise well suited to the uses and purposes for which it is intended.

Other and further objects of my invention will appear from the following specification and accompanying drawings which form a part hereof. In carrying out the objects of my invention it is to be understood that its structures and features are susceptible to change in design and arrangement with only one preferred and practical embodiment of the best known mode being illustrated in the accompanying drawings and specified as is required.

IV. BRIEF DESCRIPTIONS OF DRAWINGS

In the accompanying drawings which form a part hereof and wherein like numbers refer to similar parts throughout:

V. DESCRIPTION OF PREFERRED EMBODIMENT

Figure 1:
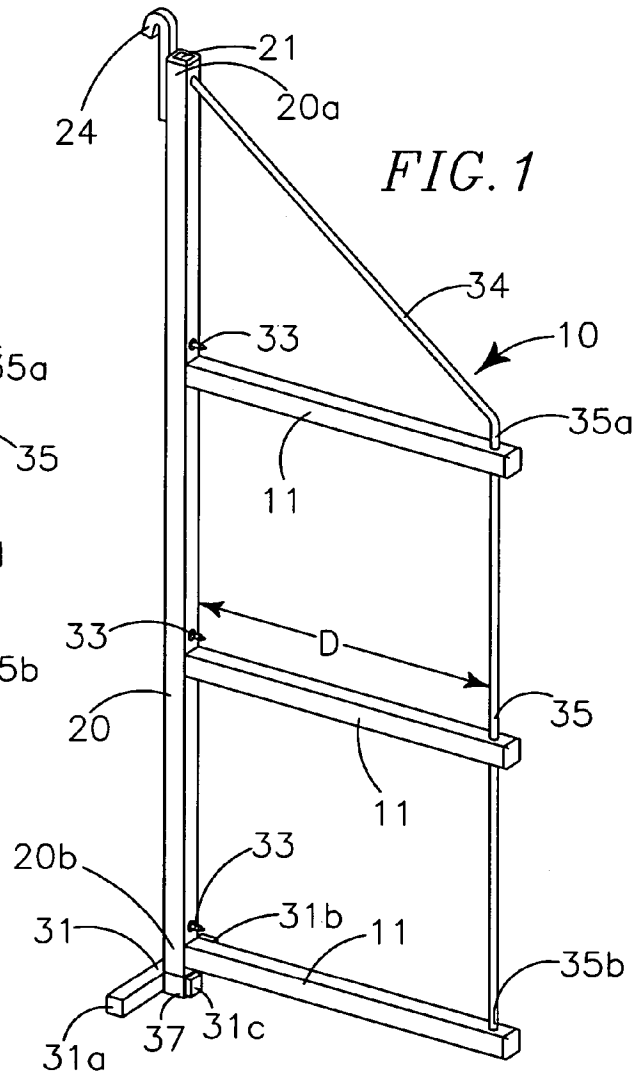
FIG. 1 is an isometric front, top and left side view of a bracket having plural structurally attached horizontal supports.
Figure 2:
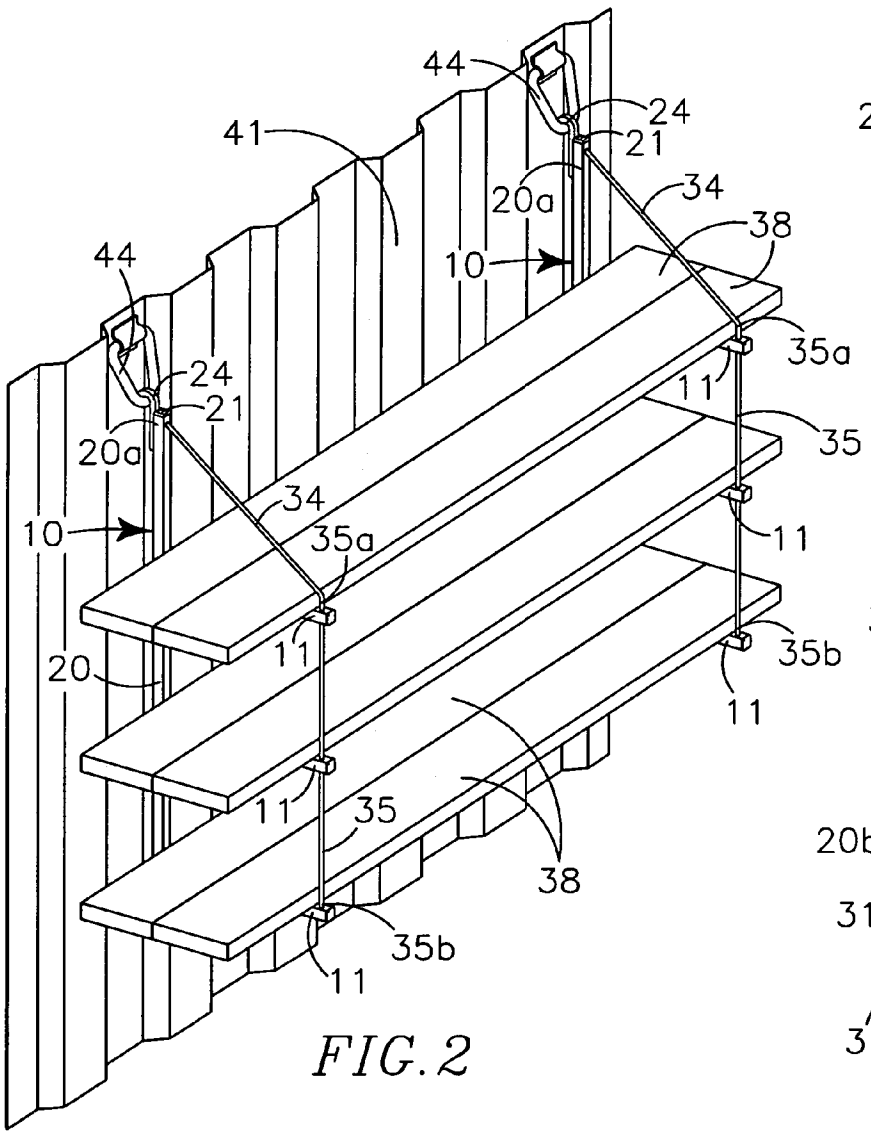
FIG. 2 is an isometric front, top and left side view of two spaced apart brackets, as shown in FIG. 1, depending from lashing rings inside a Sea-Land shipping container with shelves installed on the supports.
Figure 4:
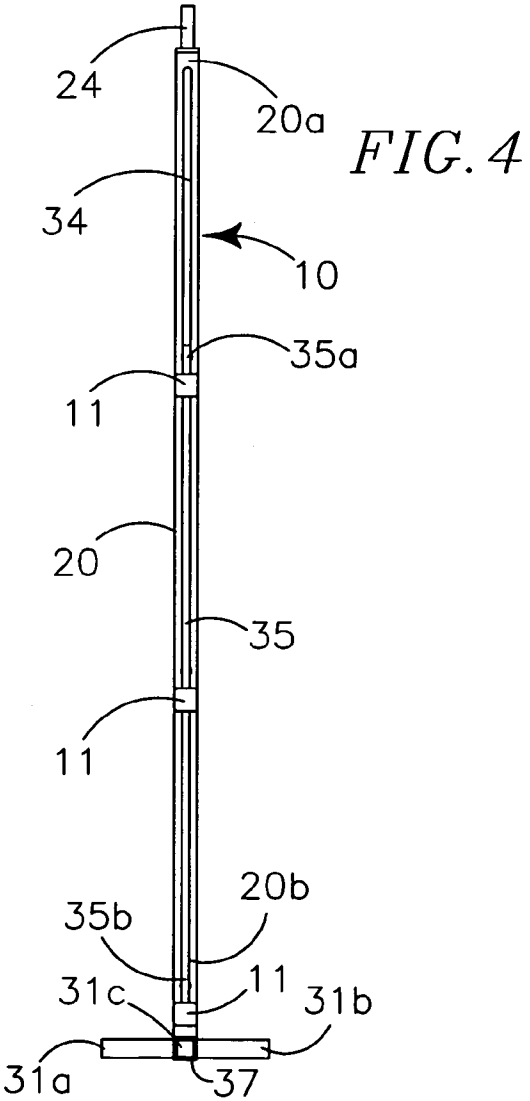
FIG. 4 is an orthographic front view of the bracket of FIG. 1.
Figure 3:
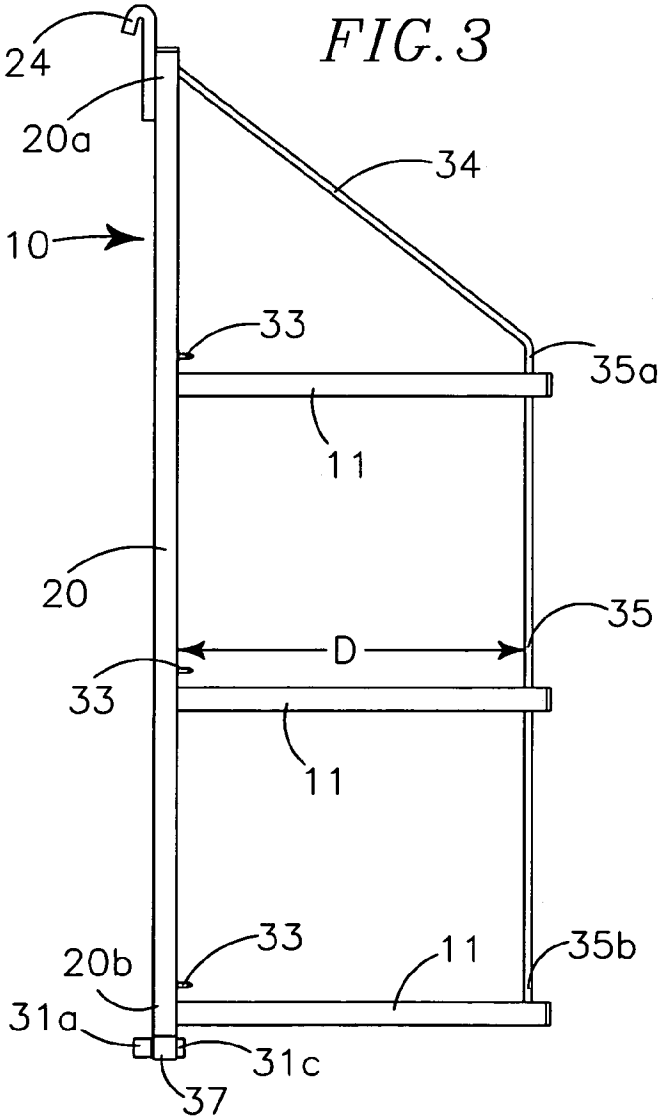
FIG. 3 is an orthographic left side view of the bracket of FIG. 1, which is the same as a right side view.
Figure 6:
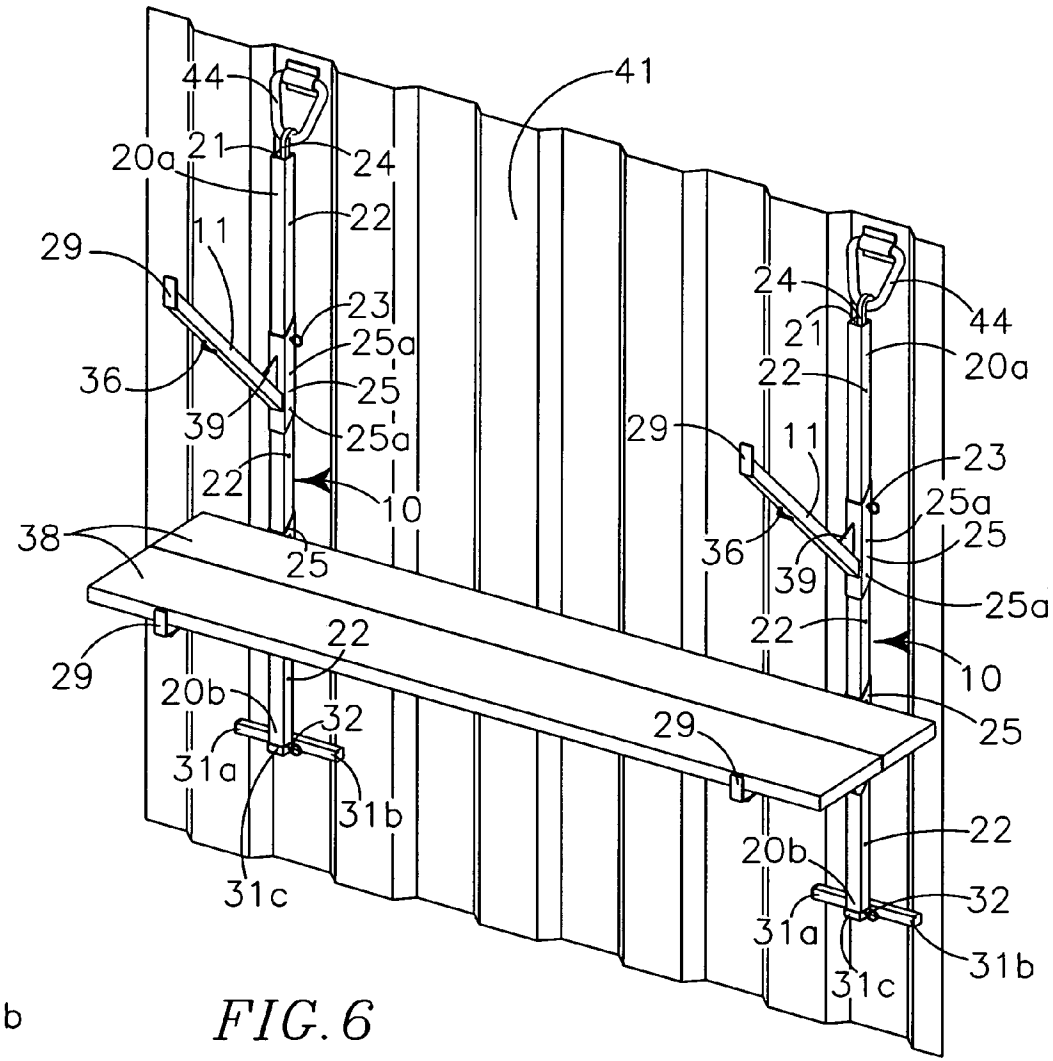
FIG. 6 is an isometric front, top and right side view of two spaced apart brackets, as shown in FIG. 5, depending from lashing rings inside a Sea-Land shipping container with shelves installed on the lower horizontal supports.

As used herein, the term "back", its derivatives, and grammatical equivalents refers to the portion of my storage system for inside a Sea-Land shipping container that is proximate to shipping container vertical wall. The term "front", its derivatives, and grammatical equivalents refers to the portion of my storage system for inside a Sea-Land shipping container that is distal from the shipping container vertical wall.

My storage system for inside a Sea-Land shipping container provides at least two brackets 10.

Each bracket 10 has a hanging beam 20 with a first upper end portion 20*a*, a second lower end portion 20*b* and defines a medial channel 21 extending therethrough. The hanging beam 20 is preferably formed from an elongate segment of steel box beam. A hook 24 is structurally carried at the first upper end portion 20*a* of each hanging beam 20 to releasably engage with a lashing ring 44 carried inside the Sea-Land shipping container on the vertical wall 41 spacedly above a floor (not shown).

A squaring foot 31 of steel box beam having a first end portion 31*a*, an opposing second end portion 31*b*, and a hanging beam connector 31*c* is releasably carried at the second lower end portion 21*b* of the hanging beam 20.

Plural supports 11 are carried by each hanging beam 20 and extend forwardly outwardly therefrom. As shown in FIGS. 1 through 4, the supports 11 may be structurally fastened to the hanging beam 20 such as by welding, or as shown in FIGS. 5 through 9, the supports 11 may be adjustably positionable on the hanging beam 20 by means of a support sleeve 25 structurally carried at rearward end portion of the support 11. Support sleeve 25 defines a rectilinear medial channel (not shown) in which the hanging beam 20 is axially carried permitting the support 11 to be adjustably positioned on the hanging beam 20. A locking pin 23 positionally secures the sleeve 25 and support 11 to the hanging beam 20.

Depending upon the type of material to be carried on the supports 11, the supports 11 may extend perpendicularly from the hanging beam 20 (FIGS. 2 and 6) such as to support shelf planks 38, the supports 11 may angle upwardly relative to the hanging beam 20 (FIG. 7) to support pipe stock, and the supports 11 may angle downwardly relative to the hanging beam 20 (FIG. 9) to support larger items such as sheets of plywood.

In a first embodiment, as shown in FIGS. 1 through 4, three vertically spaced supports 11 extend perpendicularly forwardly from the hanging beam 20 between the first upper end portion 20*a* and the second lower end portion 20*b*. A support stabilizer 35 having a first upper end portion 35*a* and a second lower end portion 35*b* is structurally connected to forward end portions of each support 11 and is parallel to the hanging beam 20. The uppermost end 35*a* of the support stabilizer 35 extends spacedly above uppermost support 11 that is proximate to the hook 24. An angulated brace 34 structurally communicates between the first upper end portion 20*a* of the hanging beam 20 and the upper end 35*a* of the support stabilizer 35. It is preferable the support stabilizer 35 and angulated brace 34 are formed of a single segment of rod stock that extends through vertically spaced aligned holes (not shown) defined in forward end portions of the supports 11 so as to add rigidity and strength to the bracket 10 and the supports 11 carried thereon.

Horizontal distance D (FIG. 3) between forward edge portion of the hanging beam 20 and rearward edge portion of the support stabilizer 35 positionally maintains shelf planks 38 therebetween by frictionally engaging with forward and rearward edge portions of the planks 38. Although three supports 11 are shown in the first embodiment (FIGS. 1 through 4) fewer supports 11 and additional supports 11 may be carried by the hanging beam 20.

In the first embodiment (FIGS. 1 through 4) the hanging beam connector 31*c* is a rectilinear protuberance extending forwardly perpendicularly from the squaring foot 31 medially between the first end 31*a* and the second end 31*b*. The hanging beam connector 31*c* releasably engages with a rectilinear loop 37 that is structurally carried at the second lower end 20*b* of the hanging beam 20. The rectilinear loop 37 defines a rectilinear channel (not shown) therethrough into which the hanging beam connector 31*c* of the squaring foot 31 extends and is positionally maintained by gravity because the hook 24 is slightly off-set from the first upper end portion 20*a* of the hanging beam 20 causing the second end portion 20*b* to pivot toward the vertical wall 41 and remain immediately adjacent the vertical wall 41.

Figures 7, 8, 9:
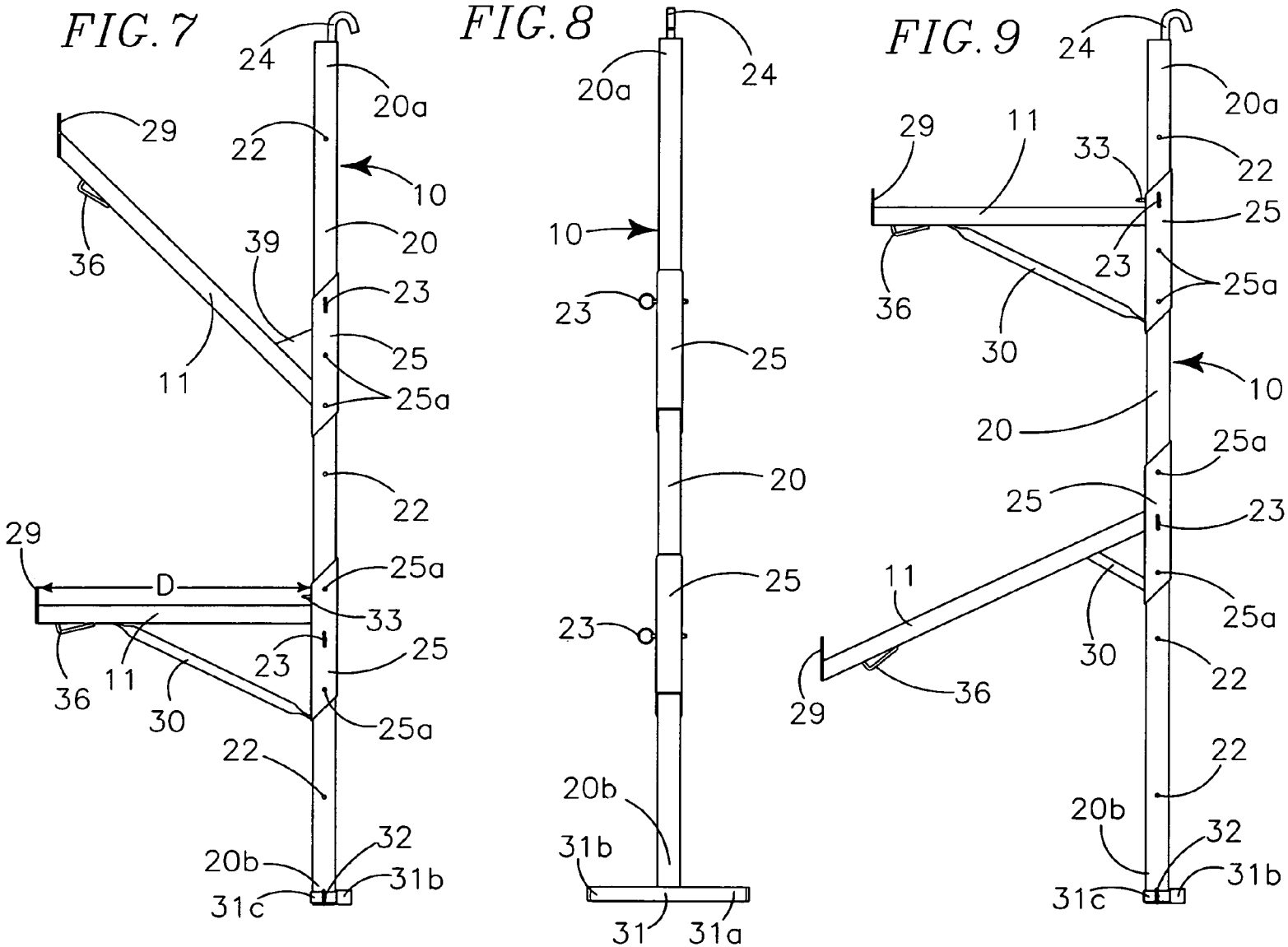
FIG. 7 is an orthographic right side view of the bracket of FIG. 5, which is the same as a left side view.
FIG. 8 is an orthographic back view of the bracket of FIG. 5.
FIG. 9 is an orthographic right side view of a bracket, similar to the bracket of FIG. 7, showing a lower downwardly angulated support carried by the hanging beam.

In a second embodiment, as shown in FIGS. 5 through 9, supports 11 are adjustably positionable on the hanging beam 20 which defines plural vertically spaced holes 22 therein. The support sleeve 25 is formed of a box beam segment and defines a rectilinear medial channel (not shown) therethrough. Locking pin holes 25*a* are defined in the support sleeve 25 to releasably carry a locking pin 23 that extends therethrough and through aligned holes 22 defined in the hanging beam 20. A forwardly extending support 11 is structurally attached to each sleeve 25 and may be angled upwardly (FIG. 7), downwardly (FIG. 9), or be perpendicular (FIG. 7) relative to the support sleeve 25 depending upon the intended use of the support 11. As shown in FIGS. 7 and 9, a variety of supports 11 may be carried on the hanging beam 20 simultaneously. A lip 29 is structurally carried at forward end portion of each support 11, opposite the support sleeve 25 and extends vertically above upper surface of the support 11. Similar to the support stabilizer 35 of the first embodiment, the lip 29 maintains shelf planks 38 on the support 11 by frictionally engaging with the forward edge thereof while the rearward edge of the shelf plank 38 frictionally engages with forward edge portion of the support sleeve 25. The lip 29 also inhibits materials such as sheets of plywood carried on the support 11 from falling off the forward end of the support 11.

Figure 5:
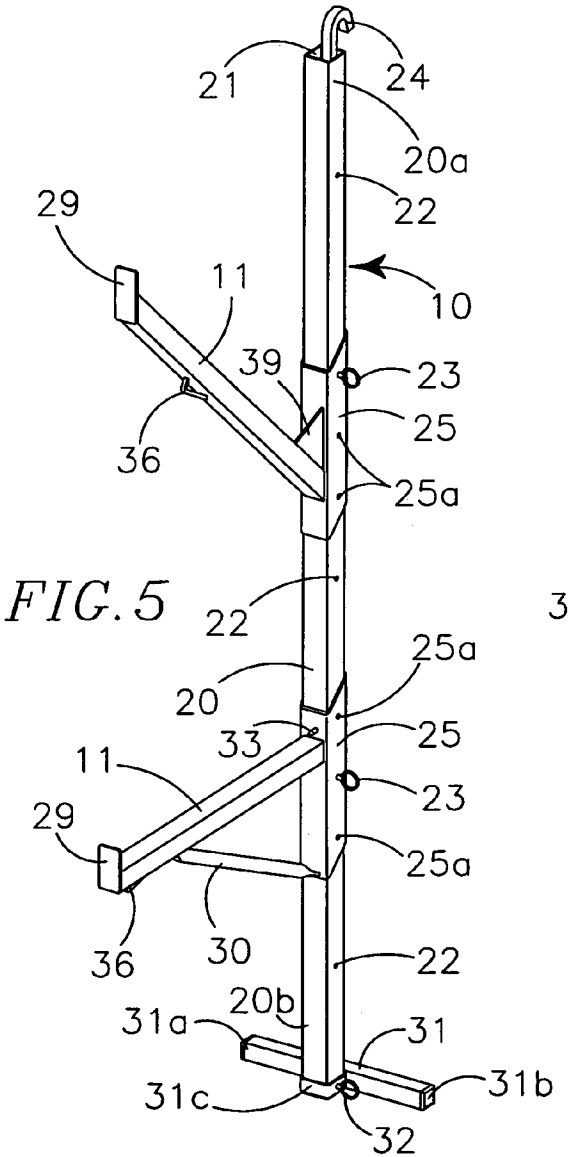
FIG. 5 is an isometric front, top and right side view of a bracket having an upper angulated support and a lower horizontal support, each support adjustably positionally maintained on the hanging beam by a support sleeve through which the hanging beam extends, and a locking pin extending therethrough.

A support truss 30 structurally communicates between forward portion of the support sleeve 25 and bottom portion of horizontal supports 11 (FIG. 7) and downwardly angulated supports (FIG. 9) adding strength to the support 11 and structural integrity to the connection therebetween. When the supports 11 are angled upwardly relative to the support sleeve 25, such as to support tubular stock, a triangular fillet 39 is structurally fastened to the support 11 and the support sleeve 25 at the connection therebetween. (FIGS. 5 and 7).

In the second embodiment, the hanging beam connector 31*c* is a rectilinear loop of steel that fits about the periphery of the second lower end portion 20*b* of the hanging beam 20 and is structurally carried medially between the first end portion 31*a* and the second end portion 31*b* of the squaring foot 31. Holes (not shown) are defined in side portions of the hanging beam connector 31*c* and are aligned with holes (not shown) defined in the second lower end portion 20*b* of the hanging beam 20. A connecting pin 32 extends through the aligned holes (not shown) defined in the second lower end portion 20*b* and the hanging beam connector 31*c* to releasably attach the squaring foot 31 to the hanging beam 20. The squaring foot 31 prevents axial rotation of the hanging beam 20 relative to the shipping container vertical wall 41 and ensures that the supports 11 extend generally perpendicularly away from the shipping container vertical wall 41.

A strap loop 36 is structurally carried on bottom surface of each support 11 proximate to the forward end to provide an anchoring point for tie down straps (not shown) that may be used to secure materials onto the support 11.

A shelf spike 33 that extends forwardly parallel to the support 11 is structurally carried by the hanging beam 20, (FIG. 3) and by the support sleeve 25 (FIG. 7) spacedly adjacent above the support 11. The shelf spike 33 is sharpened at its non-affixed end so as to penetrate into an adjacent side portion of the shelf plank 38 as the shelf planks 38 are installed on the support 11. The shelf spikes 33 further assist in positionally maintaining shelf planks 38 on the supports 11.

Having described the structure of my storage system for inside a Sea-Land shipping container, its operation may be understood.

A bracket 10 is positioned adjacent the vertical wall 41 inside a Sea-Land shipping container with the first upper end portion 20*a* carrying the hook 24 proximate to the shipping container ceiling (not shown). The lashing ring 44 (FIGS. 2 and 6) is maneuvered so that the hook 24 may be engaged therewith. The hook 24 is interconnected with the lashing ring 44 and the bracket 10 depends vertically therefrom adjacent the vertical wall 41. The squaring foot 31 is interconnected to the hanging beam 20 by engaging the hanging beam connector 31*c* with the rectilinear loop 37 at the second lower end portion 20*b*. The connecting pin 32 is inserted through the aligned holes (not shown) defined therein securing the squaring foot 31 to the hanging beam 20.

The process of installing a second bracket 10 is repeated using another lashing ring 44 spacedly adjacent from the first installed bracket 10.

A shelf plank 38 which has previously been sized to a width of one-half the distance D between the forward edge of the hanging beam 20 and the rearward edge of the support stabilizer 35 is placed on a support 11 and maneuvered toward the hanging beam 20 forcing the shelf spike 33 to penetrate into edge portion (not shown) of the shelf plank 38 adjacent the hanging beam 20. A second shelf plank 38 is positioned on the support 11 in an angulated orientation with a rearward edge portion in frictional contact with the forwardmost edge of the previously installed first shelf plank 38, and the forward edge portion frictionally engaging with rearward edge of the support stabilizer 35. The forward edge portion of the second shelf plank 38, adjacent the rearward edge of the support stabilizer 35, is forced vertically downwardly so that it slides thereagainst until the second shelf plank 38 is parallel with the previously installed first shelf plank 38 and support 11 thereunder and the second plank 38 rests directly upon the support 11. The width of the two shelf planks 38, the shelf spike 33 and frictional contact between the forward edge of the second shelf plank 38 and the rearward edge of the support stabilizer 35 positionally maintain the shelf planks 38 on the support 11. The process is repeated to install shelf planks 38 on any other horizontal shelf supports 11 carried by the hanging beam 20.

If the second embodiment of my storage and shelving system for Sea-Land shipping containers is used, the process for mounting the brackets 10 is generally the same, however, before the brackets 10 are engaged with the lashing rings 44, supports 11 having support sleeves 25 are installed on the hanging beam 20.

The second lower end portion 20*b* of the hanging beam 20 is passed through the medial channel (not shown) defined by the support sleeve 25 with the support 11 aligned so that it extends outwardly from the hanging beam 20 opposite the hook 24. The locking pin holes 25*a* defined in the support sleeve 25 are aligned with a pair of the vertically spaced holes 22 defined in the hanging beam 20 and a locking pin 23 is inserted therethrough to secure the support sleeve 25 and support 11 in the desired position on the hanging beam 20.

The squaring foot 31 is engaged with the second lower end portion 20*b* of the hanging beam 20 before or after the hanging beam 20 is engaged with the lashing ring 44 by inserting the second lower end 20*b* of the hanging beam 20 into the hanging beam connector 31*c* of the squaring foot 31 and inserting a connecting pin 32 through the aligned holes (not shown).

If horizontally extending shelf supports 11 (FIG. 5) are installed on the hanging beam 20, the process of installing shelf planks 38 is the same as described above. If other types of supports 11, such as downwardly angulated supports 11 to carry sheets of plywood (FIG. 9), or upwardly angulated supports 11 to carry tubular stock, coils of flexible pipe and rolls of wire (FIG. 5) are installed, there is no need to install shelf planks 38.

If desired, one end portion of a tie down strap (not shown) may be connected to the strap loops 36 carried on bottom portions of the supports 11 and the non-attached end portion of the tie down strap may be looped over the material carried on the support 11 and secured to the strap loop 36 to prevent the material from falling off the support 11. Alternatively, the non-attached end portion of the tie down strap may be secured to the floor (not shown), or other connecting point in the Sea-Land shipping container, to secure the bracket 10 within the Sea-Land shipping container.

Having thusly described my invention, what I desire to protect by Letters Patent, and

What I claim is:

1. A Sea-Land shipping container storage system comprising in combination:

a Sea-Land shipping container having at least one vertical wall and a floor and spaced apart lashing rings carried by the at least one vertical wall spacedly above the floor;

two spaced apart brackets, each bracket having;

an elongate hanging beam, the beam having a square cross section with a first upper end portion and a second lower end portion, a hook structurally carried at the first upper end portion to releasably interconnect with a lashing ring inside the Sea-Land shipping container to depend from the lashing ring adjacent the wall, a squaring foot to prevent the hanging beam from rotating axially, the squaring foot having a first end portion, a second end portion and a medial portion releasably attached to the second lower end portion of the hanging beam, at least one support extending forwardly from the hanging beam of each bracket for carriage of a load thereon, each support comprising a box beam having a first end portion proximate the hanging beam and a second opposing end portion distal from the hanging beam, and means for preventing the load carried on the at least one support from falling off the second end portion of the support.

2. The Sea-Land shipping container storage system of claim 1 wherein:

the at least one support is structurally attached to the hanging beam.

3. The Sea-Land shipping container storage system of claim 1 wherein:

the at least one support extends perpendicularly forwardly from the hanging beam and carries elongate shelf planks thereon to extend between the at least one support of each spaced apart bracket.

4. The Sea-Land shipping container storage system of claim 1 wherein:

the at least one support extends angularly forwardly from the hanging beam.

5. The Sea-Land shipping container storage system of claim 1 further comprising:

a rectilinear protuberance carried at the medial portion of the squaring foot releasably engageable with a rectilinear loop defining a rectilinear channel therethrough structurally carried at the second lower end portion of the hanging beam.

6. The Sea-Land shipping container storage system of claim 1 further comprising:

a rectilinear loop defining a rectilinear channel therethrough structurally carried by the squaring foot between the first end portion and the second end portion, the rectilinear loop fitting about the periphery of the second lower end portion of the hanging beam; and a connecting pin releasably carried in aligned holes defined in side portions of the rectilinear loop and in the second lower end portion of the hanging beam.

7. The storage system for Sea-Land shipping containers of claim 1 further comprising:

a support sleeve defining a rectilinear channel extending therethrough sized to fit about periphery of the hanging beam, the support sleeve structurally interconnected to the first end portion of the at least one support which extends perpendicularly therefrom; and plural vertically spaced apart holes defined in the support sleeve and in the hanging beam to releasably carry a locking pin extending through the aligned holes.

8. The storage system for Sea-Land shipping containers of claim 1 further comprising:

a support sleeve defining a rectilinear channel extending therethrough sized to fit about periphery of the hanging beam, the support sleeve structurally interconnected to the first end portion of the at least one support which extends angularly, other than perpendicularly, therefrom; and plural vertically spaced apart holes defined in the support sleeve and in the hanging beam to releasably carry a locking pin extending through the aligned holes.

9. The Sea-Land shipping container storage system of claim 1 further comprising:

a shelf spike carried spacedly adjacent above the at least one support extending parallel thereto and forwardly from the hanging beam.

10. The Sea-Land shipping container storage system of claim 1 wherein:

the means for preventing a load from falling off the second forward end of the at least one support is a support stabilizer structurally communicating between the second forward end portions of plural vertically spaced apart supports carried by the hanging beam; and an angulated support brace communicating between upper end portion of the support stabilizer and the first upper end portion of the hanging beam.

11. The Sea-Land shipping container storage system of claim 1 wherein:

the means for preventing a load from falling off the second forward end of the at least one support is a vertically extending lip structurally carried at the second forward end portion of the at least one support.

* * * * *